United States Patent [19]

Newby

[11] Patent Number: 4,580,618

[45] Date of Patent: Apr. 8, 1986

[54] METHOD AND APPARATUS FOR COOLING A HIGH TEMPERATURE WASTE GAS USING A RADIANT HEAT TRANSFER FLUIDIZED BED TECHNIQUE

[75] Inventor: Richard A. Newby, Pittsburgh, Pa.

[73] Assignee: Westinghouse Electric Corp., Pittsburgh, Pa.

[21] Appl. No.: 711,326

[22] Filed: Mar. 13, 1985

[51] Int. Cl.[4] ..... F28C 3/16

[52] U.S. Cl. ..... 165/1; 165/104.16; 165/104.18; 165/111; 34/57 A; 432/215

[58] Field of Search ..... 165/1, 104.16, 104.18, 165/111; 34/57 A; 432/215

[56] References Cited

U.S. PATENT DOCUMENTS 2,899,375 8/1959 Fensbe et al. ..... 165/104.18

3,493,344 2/1970 St Clair ..... 432/215

4,458,747 7/1984 Berry et al. ..... 165/111

*Primary Examiner*—Albert W. Davis, Jr.

*Attorney, Agent, or Firm*—Daniel C. Abeles

[57] ABSTRACT

A method and apparatus for cooling waste gases of a temperature in excess of 800° C. using radiant heat transfer to a plurality of fluidized beds. Solid particulate material is contained within a housing and divided into a plurality of fluidized beds by baffle means and fluidizing gas injected upwardly through the solids, without transfer of solids from the upper surface of a bed to adjacent beds. The hot waste gas is cooled by radiant heat transfer through the surfaces of the beds. Heated solids are cooled by either flow through the housing and cooling of the same outside the housing, or by coolant passed through heat transfer tubes that are positioned within the beds of solid particulate material.

14 Claims, 5 Drawing Figures

METHOD AND APPARATUS FOR COOLING A HIGH TEMPERATURE WASTE GAS USING A RADIANT HEAT TRANSFER FLUIDIZED BED TECHNIQUE

CROSS-REFERENCE TO RELATED INVENTION

Reference is made to the application of the present inventor, filed on even data herewith, Ser. No. 711,321, entitled "Method and Apparatus For Cooling a High Temperature Waste Gas Using a Jetting Bed Fluidized Bed Technique".

BACKGROUND OF THE INVENTION

The present invention relates to a fluidized bed technique for use in cooling high temperature waste gases from industrial processes. Heat recovery may be effected from the hot waste gases, which are of a temperature in excess of about 800° C.

It has previously been proposed to use fluidized bed technology for heat recovery from hot waste gases of various industrial processes. Problems are associated with the use of fluidized bed cooling of waste gases, such as, for example; (1) the fluidized bed gas distributor is prone to deposition and plugging and mechanical failure due to contact with the waste gases and contaminants therein, and such distributors are expensive, complex fabrication items, (2) heat transfer tubes (heat transfer surfaces) in such fluidized beds are also prone to corrosion, erosion, and fouling in hot, dirty, fluidized bed environments, (3) inefficient heat recovery is achieved due to the need for gas precooling by dilution in some systems and well-mixed, single-stage heat transport behavior, and (4) the particular material used in fluidized bed may agglomerate due to deposition, resulting in potential bed defluidization or clinker formation.

It is an object of the present invention to provide a method and apparatus using fluidized bed techniques that solve the aforementioned four major problems and provide an efficient means for cooling of hot waste gases. In the present invention, the gas distributor is not contacted by the hot waste gas, with a fluidized bed being heated mainly by radiation from above, and relatively small amounts of cooler gas used to fluidize a bed of solid particulate material. Plugging, deposition and mechanical design considerations are based on conventional practice, depending on the extent of fluidizing air preheat or the ratio of air dilution of waste gas in the fluidizing gas stream. Where heat transfer tubes are present in the fluidized bed, in the present invention, such tubes are not subjected directly to the hot waste gases, minimizing corrosion and fouling concerns, while tube erosion is limited by operating with a relatively gentle fluidizing condition in the bed. Also, heat transfer, in the preferred embodiment of the present invention is promoted by a countercurrent heat transfer, especially as a high temperature radiant cooler stage. The present fluidized bed technique can be coupled with conventional staged fluidized bed heat exchanges for high overall heat recovery effectiveness, depending upon the deposition nature of the waste gas. Additionally, bed material agglomeration is avoided by limiting direct contact made between the solid particulate material of the fluidized bed and the hot waste gas.

SUMMARY OF THE INVENTION

An apparatus and method for cooling high temperature waste gases by radiation of heat to the surfaces of a plurality of fluidized beds contained within a housing. A supply of solid particulate material is contained within the lower portion of a horizontally extending housing, and is divided into a plurality of beds by spaced vertically extending baffles. The beds of solid particulate material rest on a perforated plate spaced from a closed bottom of the housing. Fluidizing gas is injected into a plenum formed between the closed bottom and perforated plate and the fluidizing gas forced upwardly through the perforated plate to fluidize the plurality of separate beds of solid particulate material, without transfer of solids from the upper surface of a bed to adjacent separate beds. The waste gas is cooled by heat transfer to the surfaces of the solid particulate matter of the plurality of fluidized beds and means provided to remove heat from the solid particulate matter.

In one embodiment of the apparatus, the vertically extending baffles are spaced from the perforated plate and means are provided for charging cooled solid particulate material to the housing, at the discharge end for the waste gases, and means provided for discharging heated solid particulate material from the housing, at the end of the housing to which the high temperature waste gases are fed. The solid particulate material is passed sequentially through the plurality of beds between the perforated plate and spaced baffles while it is heated and is then discharged from the housing. The heated solid particulate material is cooled outside the housing and then recycled thereto.

In another embodiment of the apparatus, heat transfer tubes are disposed within the plurality of fluidized beds and coolant is passed through the heat transfer tubes to indirectly remove heat from the solid particulate material of the beds. The preferred coolant is water which can be converted to steam in the heat transfer tubes for use as a supplementary energy source.

DETAILED DESCRIPTION

The present invention uses a fluidized bed technique for cooling of a high temperature waste gas and heat recovery therefrom. The term "high temperature" is used to denote temperatures in excess of about 800° C., which temperatures cause difficulties in conventional fluidized bed heat recovery systems, and waste gas temperatures of up to about 1550° C. should be acceptable to the present cooling system.

Figure 1:
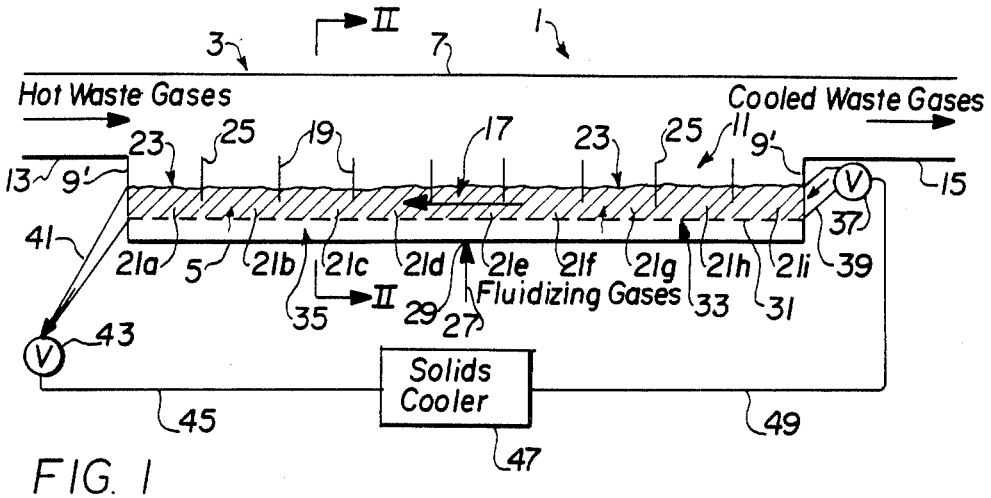
FIG. 1 is a vertical cross-sectional view of an embodiment of the present apparatus for use in the present method, where countercurrent flow of solid particulate material in the fluidized beds is effected relative to the hot waste gas flow.
Figure 2:
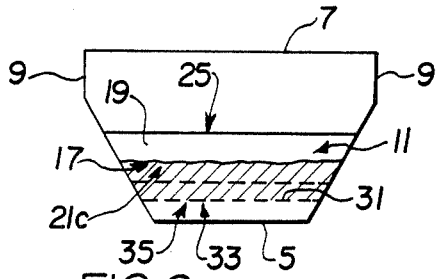
FIG. 2 is a view taken along lines II—II of FIG. 1.

Referring now to FIGS. 1 and 2, a schematic illustration of an apparatus for use with the present method is shown. The apparatus 1, comprises a horizontally extending housing 3, having a closed bottom 5, closed top 7, and closed side and end walls 9 and 9', the side walls 9 being downwardly and inwardly directed towards closed bottom 5 to form a trough-like chamber 11 at the lower portion of the enclosure 3. High temperature waste gases are passed into the housing 3 through an inlet duct 13 and, after cooling, passed out of the housing 3 through an exhaust duct 15. A supply of solid particulate material 17, suitable for fluidized bed formation, is positioned in the chamber 11 of the enclosure 3, with means, such as vertically extending transverse spaced baffles 19 provided to divide the supply of solid particulate material into a plurality of separate beds 21, illustrated as nine such beds 21*a*–21*i*, although the number of separate beds may vary depending upon the particular system. Each of the beds 21*a*–21*i* has an upper surface 23 which, when fluidization of the bed is effected, remains below the top 25 of each baffle 19. Fluidization of the beds 21*a*–21*i* of the supply of solid particulate material 17 is effected by injecting a fluidizing gas from a source (not shown) through a line 27, and an opening or openings 29 in the closed bottom 5. A fluidizing gas distributor plate 31 such as a plate with perforations 33, or other distributor means is spaced from the closed bottom 5 to form a plenum 35, from which the fluidizing gas is directed upwardly into the beds 21*a*–21*i* to fluidize the same. The fluidization of the beds 21*a*–21*i* is effected in a manner to prevent transfer of solid particulate material 17 from the upper surface 23 of one bed to an adjacent bed.

As the high temperature waste gases pass over the upper surfaces 23 of the plurality of separate fluidized beds 21*a*–21*i*, the solid particulate material is heated, by radiation, by the waste gases, through contact of the waste gases with the upper surfaces 23. The heat is removed from the solid particulate matter by effecting a countercurrent flow of the supply of solid particulate matter 17 relative to the flow of waste gases and discharge thereof from the housing 3. As illustrated, the baffles 19 are above and spaced from the fluidizing gas distributor plate 31 to provide for movement of solid particulate matter 17 therebetween. Cool solid particulate matter is charged, such as through a valve 37 into a chute 39 and then into the enclosure 3 at the end 9' having discharge duct 15. Movement of the solid particulate material 17 towards the end 9' of the enclosure having inlet duct 13 for the waste gas is effected, by the hydrostatic pressure of the bed, which acts in the nature of a liquid, with the heated solid particulate material discharged through a second chute 41 from the housing 3. A further valve 43 is used to direct the hot solid particulate material through line 45 to a solids cooler 47. In the solids cooler 47, the heat from the hot solid particulate material is reclaimed. The cooled solid particulate material may then be passed through line 49 back to valve 37 for recycle to the housing 3.

Figure 3:
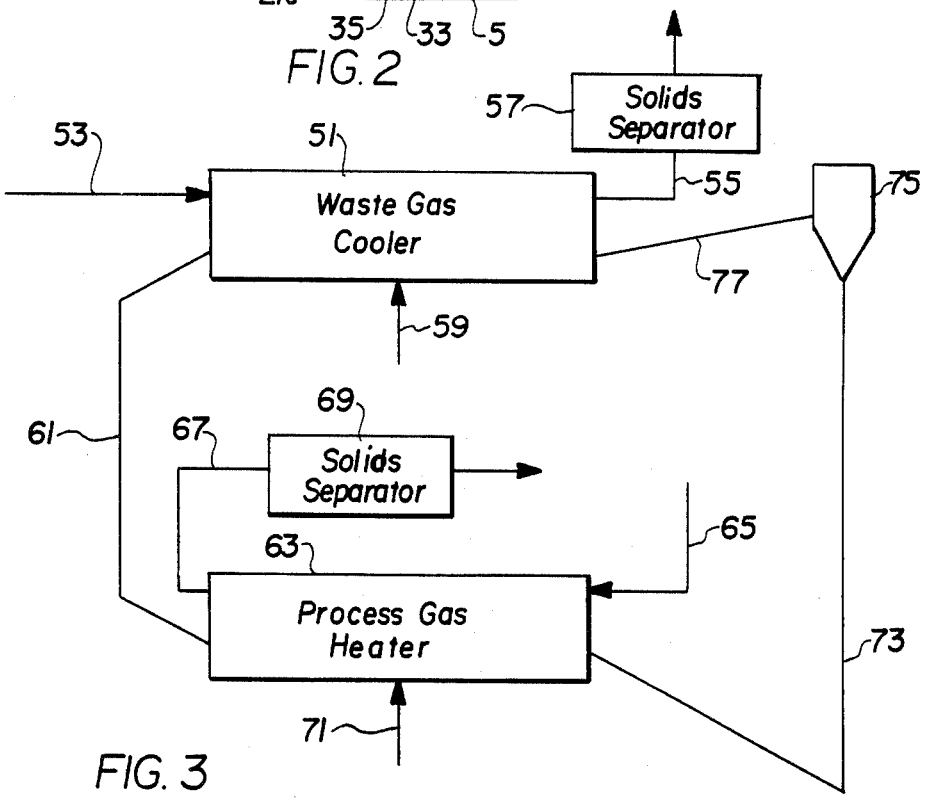
FIG. 3 is a flow diagram schematically illustrating an embodiment of the method of the present invention where an apparatus as illustrated in FIG. 1, is used to cool hot waste gases, and hot solid particulate material discharged from the housing is used in a second housing for heating of a process gas prior to return to the housing.

The incorporation of the apparatus described in FIG. 1 into a system for heating air for use in a process, from which the hot waste gases eventually are removed for cooling, or for some other process, is illustrated schematically in the flow chart of FIG. 3.

As shown, the waste gas cooler 51, such as apparatus 1 of FIG. 1, has the hot waste gases charged thereto through line 53 and, after cooling, discharged therefrom through line 55 which may contain a solids separator 57 for particulate control. The cooled gas is then discharged through a stack (not shown) to the atmosphere. Fluidizing gas is injected into the waste gas cooler 51, to fluidize the plurality of bed therein, through line 59, which gas mixes with the waste gas and is exhausted therewith. By cooling of the hot waste gases, solid particulate material, in the waste gas cooler 51, becomes heated and is discharged through line 61 to a heat recovery unit 63. The heat recovery unit 63 can be the same construction as waste gas cooler 51, except that in this instance it is used to transfer heat from hot solid particulate material to a cool gas flow. Cool gas, such as process air, that is to be heated for use in the process for which the hot waste gases are removed, or for some other purpose, is charge to the heat recovery unit 63 through line 65 and, after heating of the gas by contact with the hot solid particulate material, discharged through line 67, which may contain a solids separator 69, is fed to the process wherein heated air is required. Fluidized gas is injected into the process gas cooler 63 through line 71 to fluidize the plurality of beds of solid particulate material therein. The solid particulate material, after cooling through contact with the process gas, is discharged from the process gas cooler 63 through line 73 and returned to a supply, such as a hopper 75, from which cooled solid particulate material is charged through line 77 to the waste gas cooler 51.

In the present preferred method, the hot waste gases are introduced into a housing at one end and flow over a plurality of separated fluidized beds, radiating heat to the surfaces of the beds. While some convective heat transfer between the hot waste gas and the bed surfaces may occur, as at points of splashing, primary heat transfer is through radiation.

The apparatus described will be adaptable to space limitations involved in the retrofil of a large percentage of existing industrial high temperature processes, and is more compact than more conventional fluidized bed technique coolers.

It is estimated that the size of an apparatus according to the present invention for about a 1550° C. waste gas stream flowing at a rate of about 4,248 standard cubic meters/hour, would be about 9 to 18 meters long (depending on gas and particle radiant condition) and about 1.55 meters wide by 1.55 meters in height.

The present invention results in low-fouling heat transfer surface conditions. This is achieved by minimizing direct contact between the fouling gas and heat transfer surfaces, relying on some hot gas quenching by the bed particles to reduce the deposition rate (for some industrial gases), and applying the tendency of fluidized bed circulation to keep surfaces clean (again, depending on the nature of the deposit). In general, the success of these mechanisms to limit heat transfer surface fouling, and indeed the need for concern over fouling, depends on the nature of the source gas.

The reliability of conventional high temperature fluidized bed heat recovery devices deailing with highly fouling gases is typically limited by gas distributor operating problems (plugging and mechanical failure), heat transfer tube surface corrosion, erosion, and fouling and by bed material agglomeration. These reliability limitations are accounted for in the present invention. The present invention provides the potential for highly reliable operation, specifically avoiding these major problem areas.

Secondary concerns in the area of reliability associated with tube support, tube vibration, thermal expansion, thermal cycling, bed particle attrition, and bed material elutriation are minimized through application of conventional design techniques.

The preferred embodiment of the present invention approaches countercurrent flow, resulting in highly efficient heat transfer. Multiple modules are easily coupled in series to give high overall effectiveness of heat recovery. The overall module pressure drop will be comparable with other fluidized bed heat recovery concepts and can be tailored to the requirements of the specific application. Other auxiliary power losses, such as for the pneumatic circulation of bed material between vessels for some cases of air preheat, will also be maintained low through the application of design techniques and components.

The present fluid bed waste heat recovery application has a potential to operate efficiently under severe conditions where developing ceramic heat recovery units are not suitable, such as those typical of glass melting furnaces, or where developing fluid bed concepts are not efficient or reliable.

Figure 4:
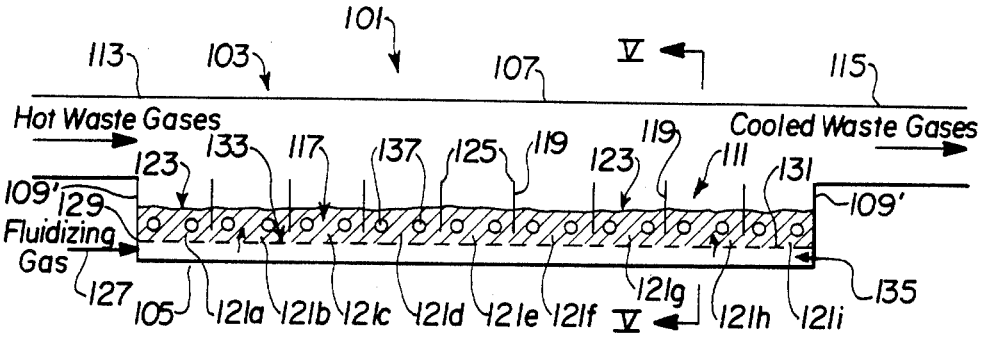
FIG. 4 is a vertical cross-sectional view of another embodiment of the present invention for use in the present method, where heat exchange tubes are disposed in the plurality of fluidized beds to remove heat from the solid particulate material contained therein.
Figure 5:
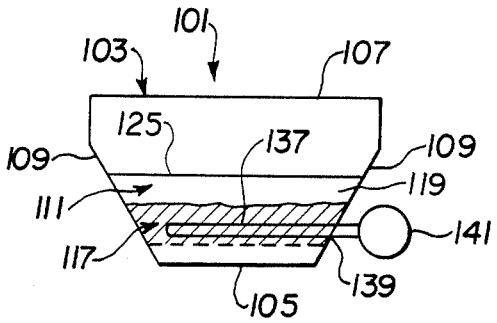
FIG. 5 is a view taken along lines V—V of FIG. 4.

Another embodiment of the present invention is illustrated in FIGS. 4 and 5, wherein the means for removing heat from the solid particulate material of the plurality of fluidized beds comprises heat transfer tubes positioned within the bed. As illustrated, the apparatus 101 comprises a horizontally extending housing 103 having a closed bottom 105, closed top 107 and downwardly and inwardly directed closed sidewalls 109 and end walls 109', that form a chamber or trough 111 in the lower portion of the enclosure. Hot waste gases enter the enclosure 103 through inlet duct 113 and, after cooling, are exhausted through duct 115. A supply of solid particulate material 117, for fluidization, is provided in chamber 111, and vertically extending spaced transverse baffles 119 divide the supply of solid particulate material 117 into a plurality of separate beds, **121*a*–121*i*. Each of the separate beds 121*a*–121*i* has an upper surface 123 that, when fluidized, remains below the top 125 of the baffles 119. A fluidizing gas is injected at or adjacent to the bottom wall 105 of the housing through line 127 and opening 129, which gas passes through a distributor plate 131, having perforation 133, spaced from the bottom wall 105, by means of the plenum 135 formed therebetween. The fluidization of the beds 121*a*–121*i* is effected so as to prevent overflow of solid particulate material from a bed to adjacent beds, the solid particulate material retained within a particulate bed by baffles 119**.

In this embodiment, the means for removing heat from the fluidized beds **121*a*–121*i* of solid particulate matter comprises conduits 137 which carry a coolant, the conduits passing through openings 139 in the end wall 109 of the housing and extending in the direction of the baffles 119. Means 141 for feeding coolant to the conduits 137 and removing heated coolant therefrom are provided outside the housing 103. The coolant, upon flow through conduits 137 is heated, and, if the coolant is water, steam produced that can be used as a supplemental heat source. The solid particulate matter, after being charged to the chamber 111 of housing 103 need not be removed therefrom for heat removal due to the heat transfer conduits 137. In this embodiment, however, as in the embodiment of FIGS. 1 and 2, the hot waste gases are cooled by transfer of heat by radiation to the solid particulate material at the surfaces 123 of the fluidized beds 121*a*–121*i***.

In the present invention, the solid particulate material is a solid material that is stable at the temperatures used. Alumina powder, for example, is a suitable material. The solid particulate material should have a particle size of between about 50 to 1000 microns in diameter to enable ready fluidization of the same in the plurality of fluidized beds.

The fluidizing gas can be the same gas as the waste gas, where plugging and fouling are not severe, but will normally be another gas, preferably air or steam.

In some instances, where removal of a pollutant from the waste gas, as well as cooling, is desired, a solid absorbent for the pollutant can be added to the bed of solid particulate material, and removed and regenerated for reuse, or discarded. For example, lime or limestone particles could be added to absorb sulfur dioxide, and the spent lime or limestone removed, regenerated, and returned to the housing.

What is claimed is:

1. An apparatus for cooling a stream of high temperature waste gases comprising:

a horizontally extending housing having a closed bottom which forms a chamber at the lower portion thereof for containment of a supply of solid particulate material;

means for dividing said supply of solid particulate material into a plurality of separate beds, each bed having an upper surface;

means for passing said stream of high temperature waste gases, to be cooled, into said housing at one end thereof, over the surfaces of said plurality of separate beds of solid particulate material and out of said housing at the other end thereof;

means for fluidizing said plurality of beds of solid particulate material, including means for injecting a fluidizing gas upwardly thereto, and into said waste gases, without transfer of solid particulate material from the upper surface of a bed of said separate beds to adjacent beds, whereby said high temperature waste gas is cooled through contact with and radiation to the upper surfaces of said plurality of separate fluidized beds of solid particulate material; and means for removing heat from said fluidized beds of solid particulate material.

2. The apparatus as defined in claim 1 wherein said means for injecting fluidizing gas upwardly to said plurality of beds comprises a horizontally extending perforated plate spaced from the closed bottom of said enclosure to form a plenum therebetween, and means for forcing fluidizing gas into said plenum and upwardly through said perforated plate.

3. The apparatus as defined in claim 2 wherein said means for dividing said supply of solid particulate material into a plurality of separate beds comprises vertically disposed baffles in said supply of solid particulate material extending across said horizontally extending housing, each of said baffles having an upper section extending upwardly from the upper surfaces of said beds.

4. The apparatus as defined in claim 3 wherein said baffles are spaced from said horizontally extending perforated plate.

5. The apparatus as defined in claim 4 wherein said means for removing heat from said fluidized beds of solid particulate material comprises means for charging cooled solid particulate material into said housing at said other end thereof onto said perforated plate, for passage through the enclosure countercurrent to the flow of said stream of high temperature waste gas, between said perforated plate and said spaced baffles, whereby said solid particulate material becomes heated by contact with said stream of high temperature waste gas, means for discharging heated particulate solids from said housing at said one end thereof, means for cooling said heated particulate solids outside said housing, and means for returning said cooled particulate solids back to said means for charging.

6. The apparatus as defined in claim 5 wherein said means for cooling said heated particulate solids outside said housing comprises:

a second horizontally extending housing having a closed bottom which forms a chamber at the lower portion thereof for containment of a supply of solid particulate material;

means for charging said heated particulate material to said second horizontally extending housing;

means for dividing said supply of heated solid particulate material into a plurality of separate beds, each bed having an upper surface;

means for passing a stream of cool gases, to be heated, into said housing at one end thereof, over the surfaces of said plurality of separate beds of heated solid particulate material and out of said housing at the other end thereof;

means for fluidizing said plurality of beds of solid particulate material, including means for injecting a fluidizing gas upwardly thereto, and into said cool gases, without transfer of solid particulate material from the upper surface of a bed of said separate beds to adjacent beds, whereby said cool gas is heated through contact with the upper surfaces of said plurality of separate fluidized beds of solid particulate material, and said heated solid particulate material is cooled; and returning said cooled solid particulate material to said means for charging of said housing.

7. The apparatus as defined in claim 3 wherein said means for removing heat from said fluidized beds of solid material comprises heat transfer tubes disposed within said fluidized beds, and means for passing coolant through said heat transfer tubes.

8. The apparatus as defined in claim 7 wherein said coolant is water and said water is heated, within said tubes, by said solid particulate material, to form steam.

9. A method of cooling a stream of high temperature waste gases comprising:

directing a stream of high temperature waste gases into one end of a horizontally extending housing containing a supply of solid particulate material separated into a plurality of beds extending along said enclosure;

introducing a fluidizing gas upwardly into said plurality of beds to form a plurality of separated fluidized beds having an upper surface;

passing said high temperature waste gases through said enclosure over the surfaces of said plurality of fluidized beds such that heat from said waste gases is transferred by radiation to the solid particulate material of said fluidized beds to cool the waste gases;

discharging said stream of cooled waste gases and the fluidizing gas from the other end of said horizontally extending housing; and removing heat from the solid particulate material of said plurality of fluidized beds of solid particulate material.

10. The method as defined in claim 9 wherein the removing of heat from the solid particulate material is effected by charging cooled solid particulate material to the housing at said other end, effecting flow of the solid particulate material within the housing countercurrent to the flow of waste gases therein, discharging hot solid particulate material from said one end of said housing, cooling said solid particulate material outside the housing, and returning cooled solid particulate material for charging to said other end.

11. The method as defined in claim 9 wherein the removal of heat from the solid particulate material is effected by providing heat exchange tubes within the fluidized beds of solid particulate material and passing a coolant through said heat exchange tubes.

12. The method as defined in claim 11 wherein said coolant is water.

13. The method as defined in claim 9 wherein said solid particulate material comprises alumina powder having a particle size of between 50 to 1000 microns in diameter.

14. The method as defined in claim 9 wherein said high temperature waste gases are at a temperature between 800°-1550° C. upon directing of the same into said horizontally extending housing.

* * * * *